US006470880B1

(12) United States Patent
Chang

(10) Patent No.: US 6,470,880 B1
(45) Date of Patent: Oct. 29, 2002

(54) RANGE HOOD

(75) Inventor: Hsin-Chung Chang, Taoyuan Hsien (TW)

(73) Assignee: Enlight Corp., Taoyuan Hsien (TW)

( * ) Notice: Subject to any disclaimer, the term of this patent is extended or adjusted under 35 U.S.C. 154(b) by 0 days.

(21) Appl. No.: 10/092,614

(22) Filed: Mar. 8, 2002

(51) Int. Cl.[7] ..... F24C 15/20
(52) U.S. Cl. ..... 126/299 D; 126/299 R
(58) Field of Search ..... 126/299 R, 299 D, 126/299 F, 300–303, 21 R; 55/DIG. 36; 454/67

(56) References Cited

U.S. PATENT DOCUMENTS 3,559,636 A * 2/1971 Marino ..... 126/299 D
4,614,177 A * 9/1986 Buckley et al. ..... 126/299 R
4,788,964 A * 12/1988 Dorsey et al. ..... 126/299 D
5,020,511 A * 6/1991 Liu ..... 126/299 D
5,209,697 A * 5/1993 Hurst et al. ..... 126/299 D
5,662,097 A * 9/1997 Panos ..... 126/299 D

* cited by examiner

*Primary Examiner*—James C. Yeung
(74) *Attorney, Agent, or Firm*—Troxell Law Office PLLC

(57) ABSTRACT

A range hood is constructed to include a body formed of a bottom panel, a locating plate supported on the bottom panel, a top panel mounted on the locating plate, a front control panel and a rear panel respectively fastened to the top and bottom panels at the front and rear sides, and two wind guides adjustably fastened to the locating plate and protruded over two sides of the bottom panel for guiding escaped waste gas into the inside of the body, a wind box mounted in the body to hold a fan for drawing waste gas into the body through a main suction hole in the bottom panel and suction holes in side flanges of the bottom panel, and an exhaust pipe sleeved onto the wind box and extended out of the body for guiding out waste gas from the wind box and the body.

1 Claim, 7 Drawing Sheets

RANGE HOOD

BACKGROUND OF THE INVENTION

1. Field of the Invention

The present invention relates to a range hood and, more particularly, to such a range hood, which has adjustable wind guides that guide in escaped waste gas for exhaust.

2. Description of the Related Art

In the kitchen, a range hood is suspended above the range for drawing away waste gas. A regular range hood commonly comprises a hood body having one or two suction ports and a fan mounted inside the hood body and controlled to draw waste gas into the hood body toward the exhaust pipe. During operation, a certain amount of waste gas may escape out of the suction port(s). In order to fully carry waste gas away from the range, wing guide means is necessary to guide all waste gas into the suction port(s) of the range hood.

SUMMARY OF THE INVENTION

The present invention has been accomplished under the circumstances in view. It is one object of the present invention to provide a range hood, quick requires less installation space. It is another object of the present invention to provide a range hood, which has wind guide means to effectively guide waste gas into the body of the range hood for exhaust. It is still another object of the present invention to provide a range hood, which causes a sense of beauty. According to one aspect of the present invention, the range hood comprises a body formed of a bottom panel, a locating plate supported on the bottom panel, a top panel mounted on the locating plate, a front control panel and a rear panel respectively fastened to the top and bottom panels at the front and rear sides, and two wind guides adjustably fastened to the locating plate and protruded over two sides of the bottom panel for guiding escaped waste gas into the inside of the body through suction holes in side flanges of the bottom panel, a wind box mounted in the body to hold a fan for drawing waste gas into the body through a main suction hole in the bottom panel and suction holes in side flanges of the bottom panel, and an exhaust pipe sleeved onto the wind box and extended out of the body for guiding out waste gas from the wind box and the body. According to another aspect of the present invention, the wind guides each have transverse rows of mounting holes mounted with a respective hollow pin and selectively fastened to respectively mounting holes of the top panel and the locating plate by screws.

DETAILED DESCRIPTION OF THE PREFERRED EMBODIMENT

Figure 1:
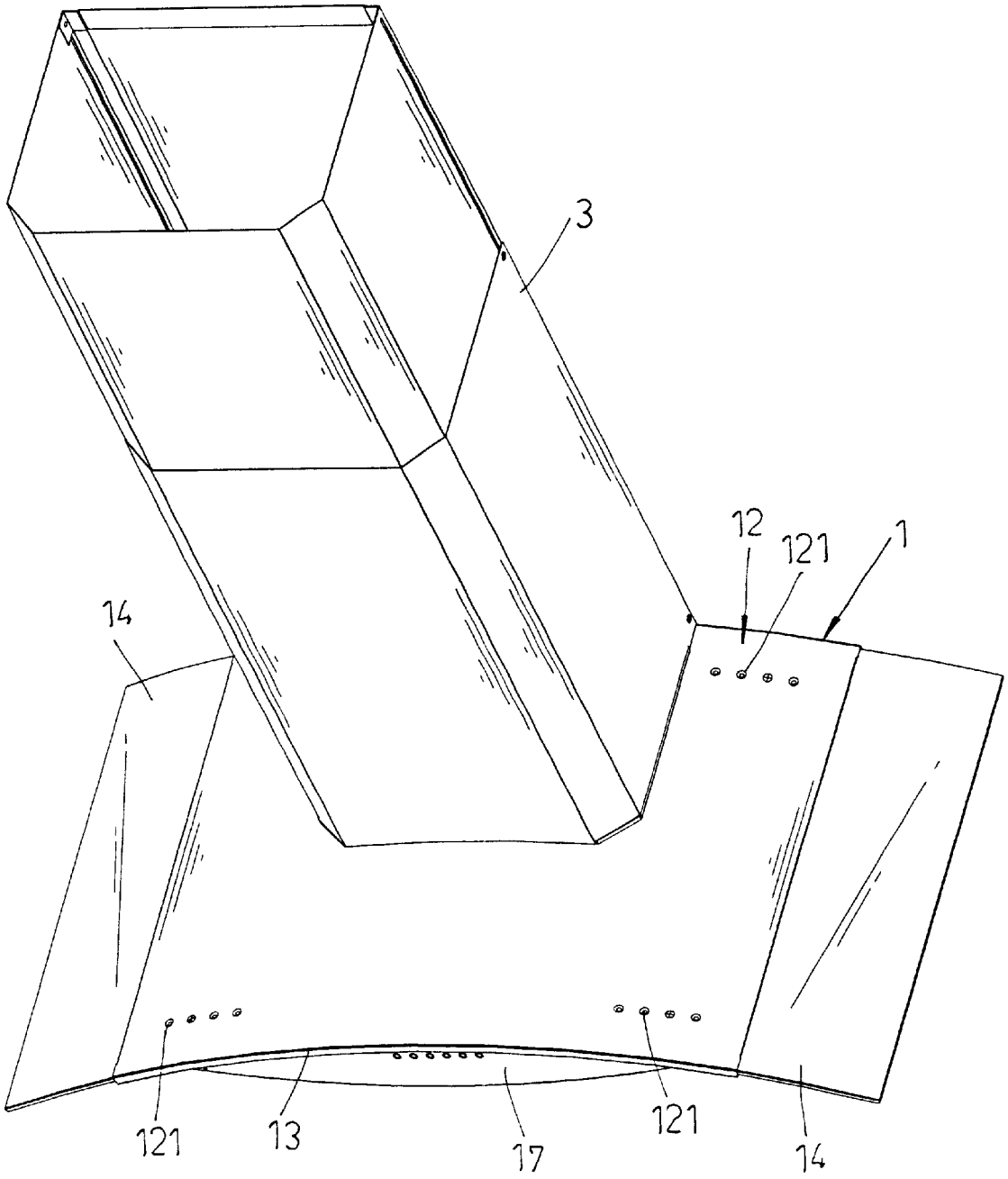
FIG. 1 is an elevational view of a range hood according to the present invention.
Figure 2:
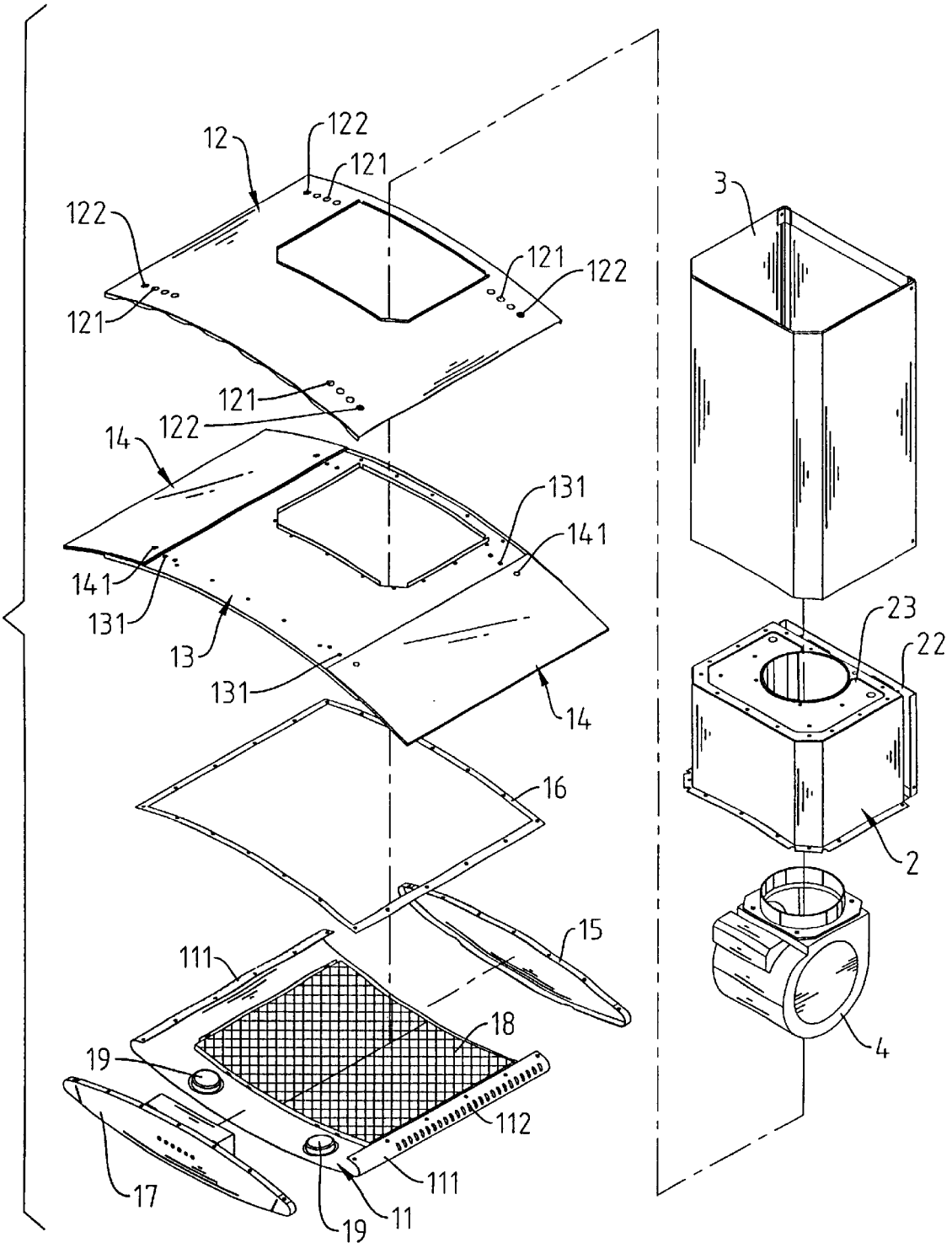
FIG. 2 is an exploded view of the range hood according to the present invention.
Figure 4:
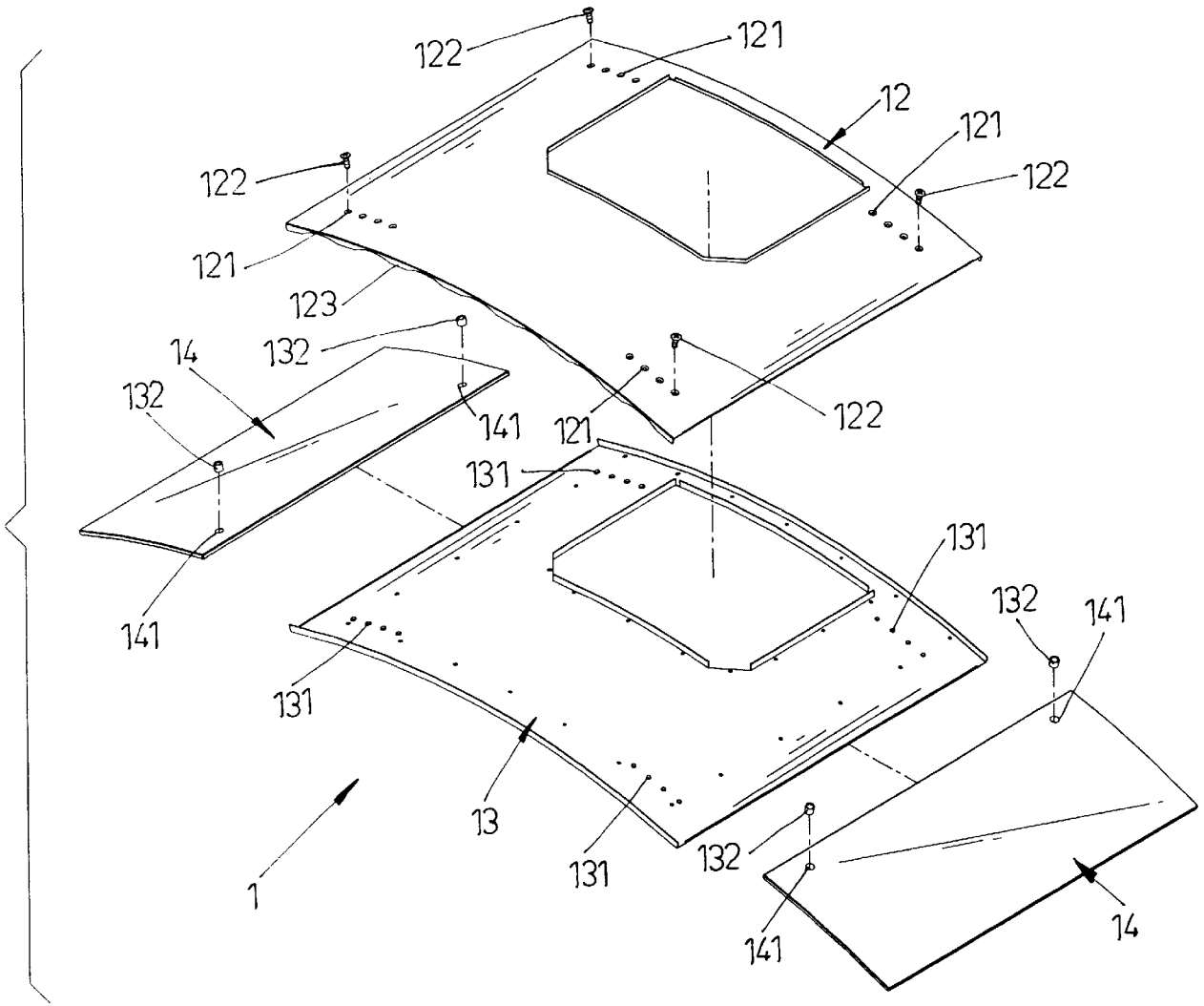
FIG. 4 is an exploded view of a part of the body of the range hood according to the present invention.
Figure 5:
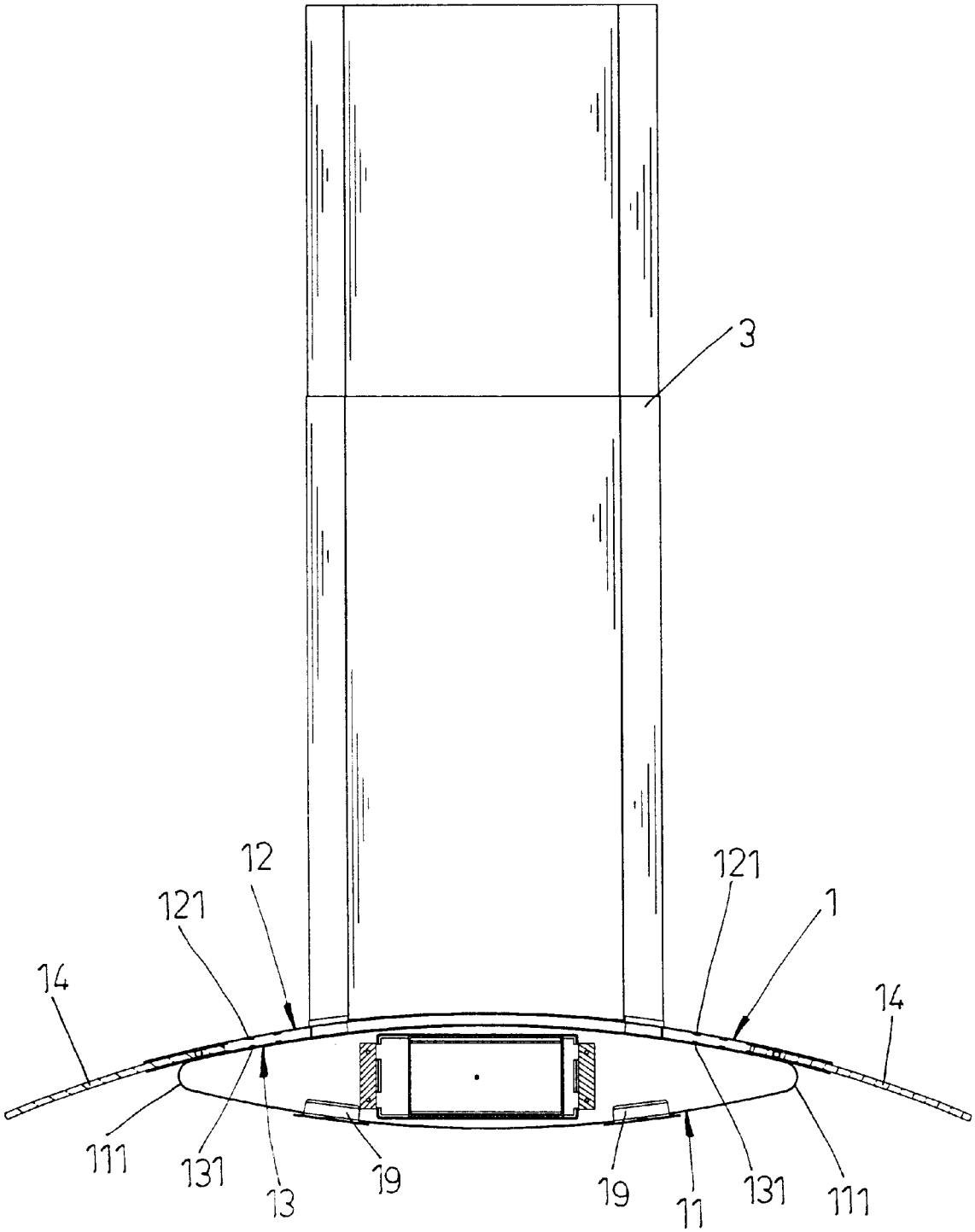
FIG. 5 is a front plain view of the range hood according to the present invention.

Referring to FIGS. 1, 2, and 4, a range hood is shown comprised of a body 1, a wind box 2, an exhaust pipe 3, and a fan 4. The body 1 comprises a bottom panel 11, a top panel 12, a locating plate 13, two wind guides 14, a rear panel 15, and a front control panel 17. The bottom panel 11 comprises two mounting flanges 111 upwardly curved from two opposite lateral sides thereof and respectively fastened to the locating plate 13, and a plurality of suction holes 112 disposed in the mounting flanges 111. A rubber packing strip 16 is sealed in between the bottom panel 11 and the locating plate 13 to prevent leakage of sucked gas. The top panel 12 is fixedly fastened to the locating plate 13 at the top side, having a plurality of mounting holes 121 disposed in four corners and respectively fastened to respective mounting holes 131 of the locating plate 13 by screws 122. The top panel 12 further comprises a plurality of bottom flanges 123 protruded from the bottom sidewall thereof at the front and rear sides and disposed in contact with the top sidewall of the locating plate 13. The wing guides 14 are bilaterally connected between the locating plate 13 and the top panel 12. The rear panel 15 is fixedly fastened to the bottom panel 11 and the top panel 12 at the rear side. The front control panel 17 is fixedly fastened to the bottom panel 11 and the top panel 12 at the front side. Lamps 19 are installed in the bottom panel 11 near the front control panel 17. A wire gauge filter 18 is in the center opening (the main suction hole) of the bottom panel 11.

Figure 3:
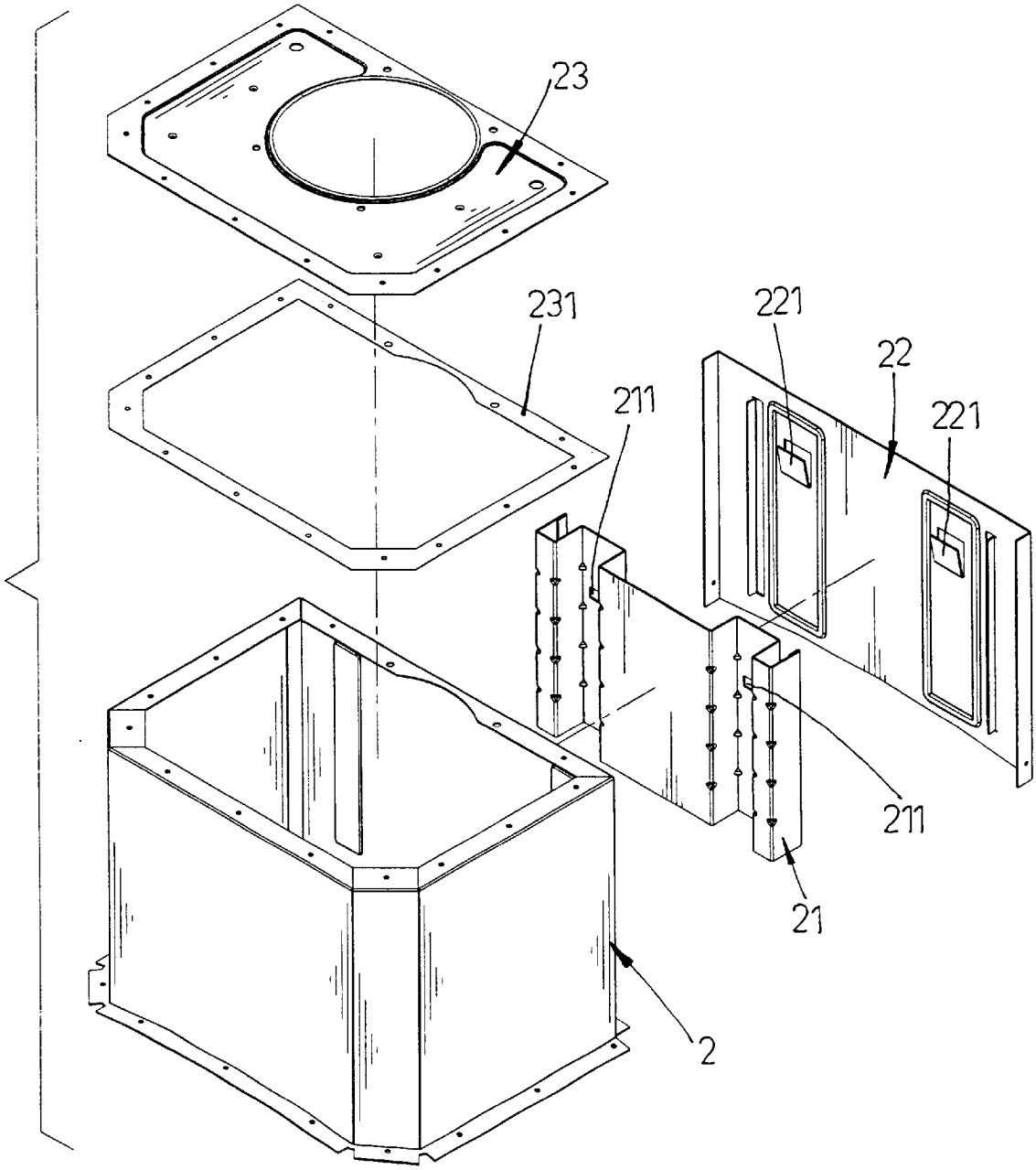
FIG. 3 is an exploded view of the wind box for the range hood according to the present invention.

Referring to FIG. 3 and FIG. 2 again, the wind box 2 holds the fan 4 on the inside. The top side of the wind box 2 is an open side covered with a cover plate 23 and connected to the top panel 12. A gasket ring 231 is sealed between the wind box 2 and the cover plate 23. The bottom side of the wind box 2 is fixedly fastened to the locating plate 13. The rear side of the wind box 2 is fixedly mounted with a positioning frame 21 by welding. The positioning frame 21 has two hook holes 211. A mounting plate 22 is provided for securing the positioning frame 21 to the wall. The mounting plate 22 has two hooks 221 for hooking in the hook holes 211 to support the wind box 2 on the wall. The exhaust pipe 3 is sleeved onto the wind box 2 and fixedly secured thereto. The exhaust pipe 3 has a certain length. When installed in the wind box 2, the exhaust pipe 3 has a part extended out of the top panel 12.

Figure 6:
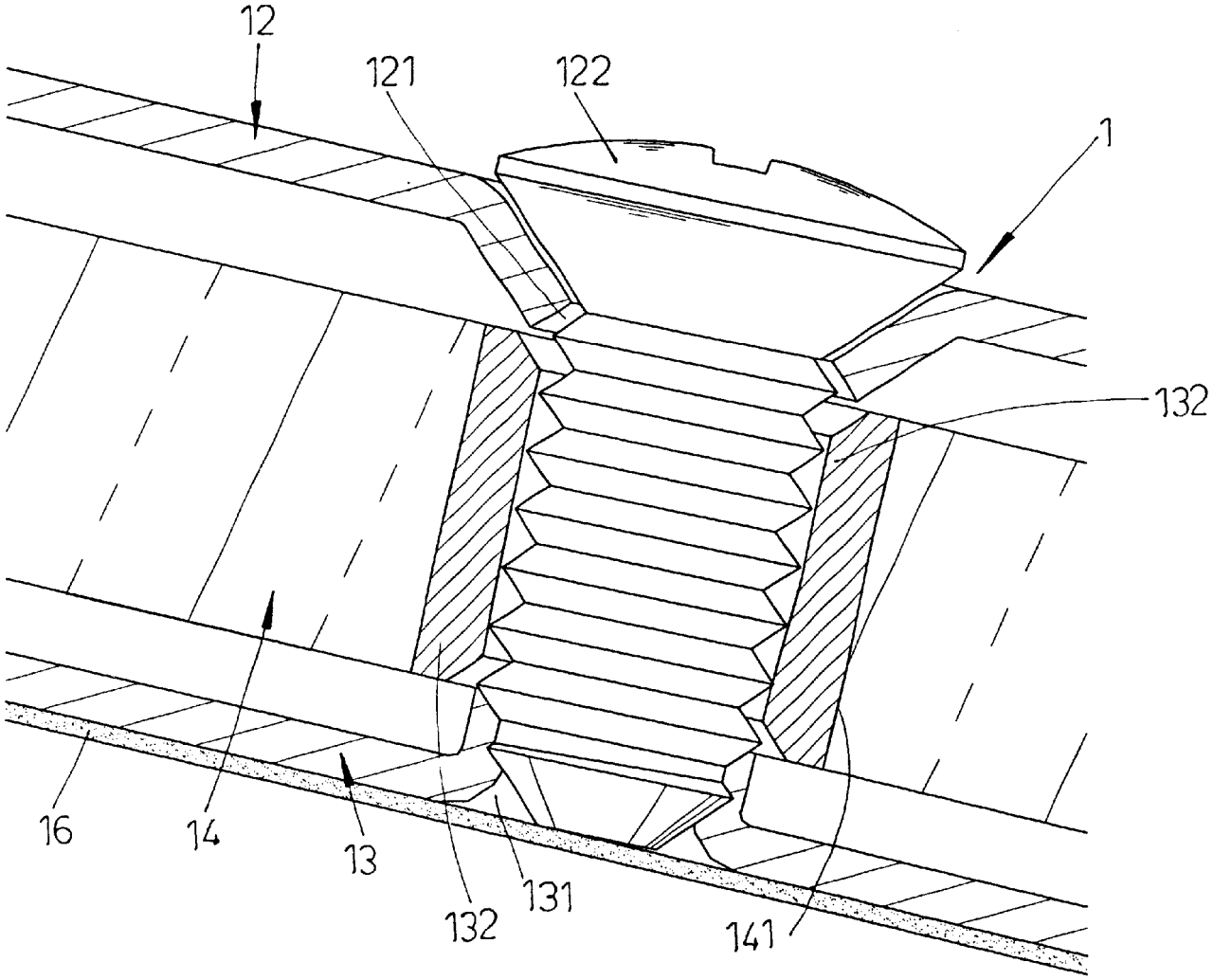
FIG. 6 is a sectional view in an enlarged scale of a part of the present invention, showing the positioning of the wind guide between the top panel and the locating plate.

Referring to FIG. 6 and FIG. 2 again, the wind guides 14 are made of smoothly arched glass plates, each having a plurality of through holes 141 respectively mounted with a respective hollow pin 132 for the passing of the corresponding screws 122 fastened to the mounting holes 121 of the top panel 12 and the respective mounting holes 131 of the locating plate 13. The mounting holes 121 of the top panel 12 are tapered holes having a diameter gradually reduced in direction toward the locating plate 13.

Figure 7:
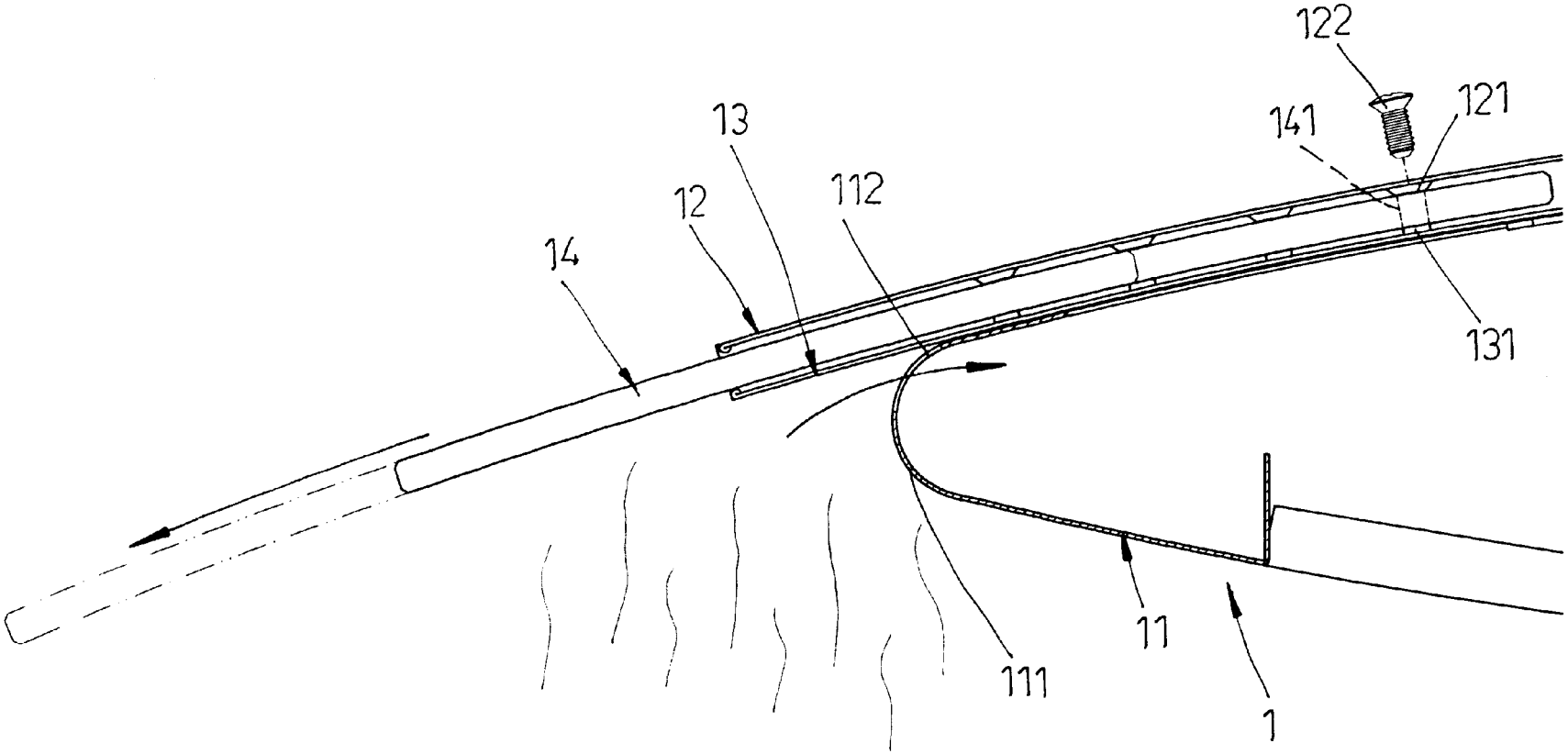
FIG. 7 is a schematic drawing showing the operation of the range hood according to the present invention.

Referring to FIG. 7 and FIGS. 1 and 2 again, when started the fan 4 to suck in waste gas through the wire gauge filter 18 (the main suction hole of the bottom panel 11), the smoothly arched wind guides 14 guide the escaped waste gas into the suction holes 112 for exhaust. Because the fan 4 is installed in the wind box 2 inside the exhaust pipe 3, the size of the range hood is minimized. Further, because the wing guides 14 have multiple through holes 141 for fastening to the screws 122 selectively, the wing guides 14 can be fastened to the locating plate 13 and the top panel 12 in one of a series of positions to change the cover area of the range hood.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A range hood comprising:

a body, said body comprising a bottom panel, said bottom panel having two mounting flanges upwardly curved from two opposite lateral sides thereof and a main suction hole disposed on the middle and a plurality of suction holes disposed in said mounting flanges, a locating plate fixedly supported on the mounting flanges of said bottom panel, said locating plate having a plurality of mounting holes in four corners thereof, a rubber packing strip sealed in between said bottom panel and said locating plate, a top panel fixedly fastened to said locating plate at a top side, said top panel comprising a plurality of mounting holes disposed in four corners thereof and respectively fastened to the mounting holes of said locating plate and a plurality of bottom flanges protruded from a bottom sidewall thereof at front and rear sides and disposed in contact with a top sidewall of said locating plate, two wing guides bilaterally connected between said locating plate and said top panel and protruding over the mounting flanges of said bottom panel for guiding waste gas into the suction holes of said bottom panel, said wind guides each having transverse rows of through holes and a plurality of hollow pins respectively mounted in the trough holes and selectively connected between the mounting holes of said top panel and the mounting holes of said locating plate by screws, a rear panel fixedly fastened to said bottom panel and said top panel at a rear side, a front control panel fixedly fastened to said bottom panel and said top panel at a front side, a plurality of lamps installed in said bottom panel near said front control panel, and a wire gauge filter in the main suction hole of said bottom panel;

a fan mounted in said body and adapted to draw waste gas into the main suction hole of said bottom panel and the suction holes of said bottom panel a wind box holding said fan in said body, said wind box having a top open side covered with a cover plate and sealed with a gasket ring, a bottom side fixedly fastened to said locating plate for guiding in waste gas through the main suction hole of said bottom panel, a positioning frame welded to a rear open side thereof, said positioning frame having a plurality of hook holes, and a mounting plate adapted for securing said positioning frame to the wall, said mounting plate having a plurality of hooks for hooking in the hook holes of said positioning frame; and an exhaust pipe sleeved onto said wind box and fixedly secured thereto for guiding waste gas out of said body and said wind box, said exhaust pipe having a part extended out of the top panel of said body.

* * * * *